US006679579B1

(12) United States Patent
Tee et al.

(10) Patent No.: US 6,679,579 B1
(45) Date of Patent: Jan. 20, 2004

(54) WIPING MECHANISM

(75) Inventors: Ah Chong Tee, Singapore (SG); Cheng Tee Tang, Singapore (SG); Cherng Linn Teo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/236,439

(22) Filed: Sep. 5, 2002

(51) Int. Cl.[7] ..... B41J 2/165
(52) U.S. Cl. ..... 347/33
(58) Field of Search ..... 347/33, 29, 30, 347/32, 35; 15/250.361, 256.5

(56) References Cited

U.S. PATENT DOCUMENTS 6,132,026 A 10/2000 Taylor ..... 347/32
6,598,955 B1 * 7/2003 Tee et al. ..... 347/33

* cited by examiner

*Primary Examiner*—Shih-Wen Hsieh

(57) ABSTRACT

A method for wiping a printhead of an inkjet printing mechanism is provided. During a wiping process, firstly, a first amount of wiping force is exerted on the printhead for wiping the printhead in a first direction. Subsequently, a smaller amount of wiping force is exerted on the printhead for wiping the printhead in a second direction opposite to the first direction. The potential damages on the printhead by a dry wiping can thus be decreased by controlling the wiping force on the printhead.

12 Claims, 4 Drawing Sheets

WIPING MECHANISM

BACKGROUND

This invention relates generally to inkjet printing mechanisms, and in particular to techniques for maintaining inkjet printhead at its optimal conditions.

Inkjet printing mechanisms use pens which shoot drops of liquid colorant, referred to generally herein as "ink," onto a media sheet. Each pen has a printhead formed with very small nozzles through which the ink drops are fired. To print an image, the printhead is propelled back and forth across the media sheet, shooting drops of ink in a desired pattern as it moves. The particular ink ejection mechanism within the printhead may take on a variety of different forms known to those skilled in the art, such as those using piezoelectric or thermal printhead technology.

To clean and protect the printhead, typically a "wiper assembly" mechanism is mounted within the housing of the printing mechanism so the printhead can be moved over the assembly for maintenance, specifically for wiping off ink residues and any paper dust or other debris that have collected on the printhead.

Normally, a wiping sequence includes a forward and a backward wiping stroke. During the forward stroke, a wiper blade of the wiper assembly moves from its home position, which is in front of the printhead in a media advancement direction, towards the other end of the printhead until it has passed the other end for wiping off ink residues on the printhead. After the forward stroke, the wiper blade moves from a position behind the printhead in the media advancement direction to its home position during the backward stroke; wiping also occurs during such a backward stroke.

The wiper blade normally has two sides at its wiping end for wiping the printhead during the forward and backward strokes respectively. During the forward stroke, most ink residues on the printhead are wiped off, and one side of the wiper blade's wiping end becomes wet due to the ink residues. However, the other side of the wiper blade's wiping end remains dry due to the fact that it is not in contact with the inks on the printhead during the forward stroke. Therefore, when the other side of the wiping end wipes the printhead during the backward stroke, a dry wiping of the printhead occurs if no other fluids are used to moisten the wiper blade. Such a dry wiping of the printhead may not be desirable in that it may increase the risk of damaging the nozzles on the printhead and the wiper blade itself.

Solutions have been introduced to solve such a problem. For example, some fluids can be used to wet the wiper blade before the backward stroke starts. However, such a solution can be relatively complicated because more parts and more complicated coordination between these parts are required to wet the wiper blade.

Therefore, there is a need for an improved printhead wiping mechanism which reduces the risk of damaging the printhead during the backward stroke of a wiping process more conveniently.

SUMMARY

According to an aspect of the present invention, a method for wiping a printhead of an inkjet printing mechanism is provided. During a wiping process, firstly, a first amount of wiping force is exerted on the printhead for wiping the printhead in a first direction. Subsequently, a smaller amount of wiping force is exerted on the printhead for wiping the printhead in a second direction opposite to the first direction. The potential damages on the printhead by a dry wiping can thus be decreased by controlling the wiping force on the printhead.

According to a second aspect of the invention, a wiper assembly is provided for wiping a printhead of an inkjet printing mechanism having a chassis, with the printhead on a carriage supported by the chassis for moving to a wiping position. The wiper assembly includes a guide track mounted to the chassis, a platform movable along the track in a forward and a backward direction during a forward and a backward wiping stroke respectively, and a wiper blade mounted on the platform for wiping the printhead when the printhead is in the wiping position. A character of the wiper blade can be adjusted so that the wiper blade exerts different amounts of wiping forces on the printhead during the forward and the backward strokes.

Other aspects and advantages of the invention will become apparent from the following detailed description, taken in conjunction with the accompanying drawings, which description illustrates by way of example the principles of the invention.

DETAILED DESCRIPTION

Figure 1:
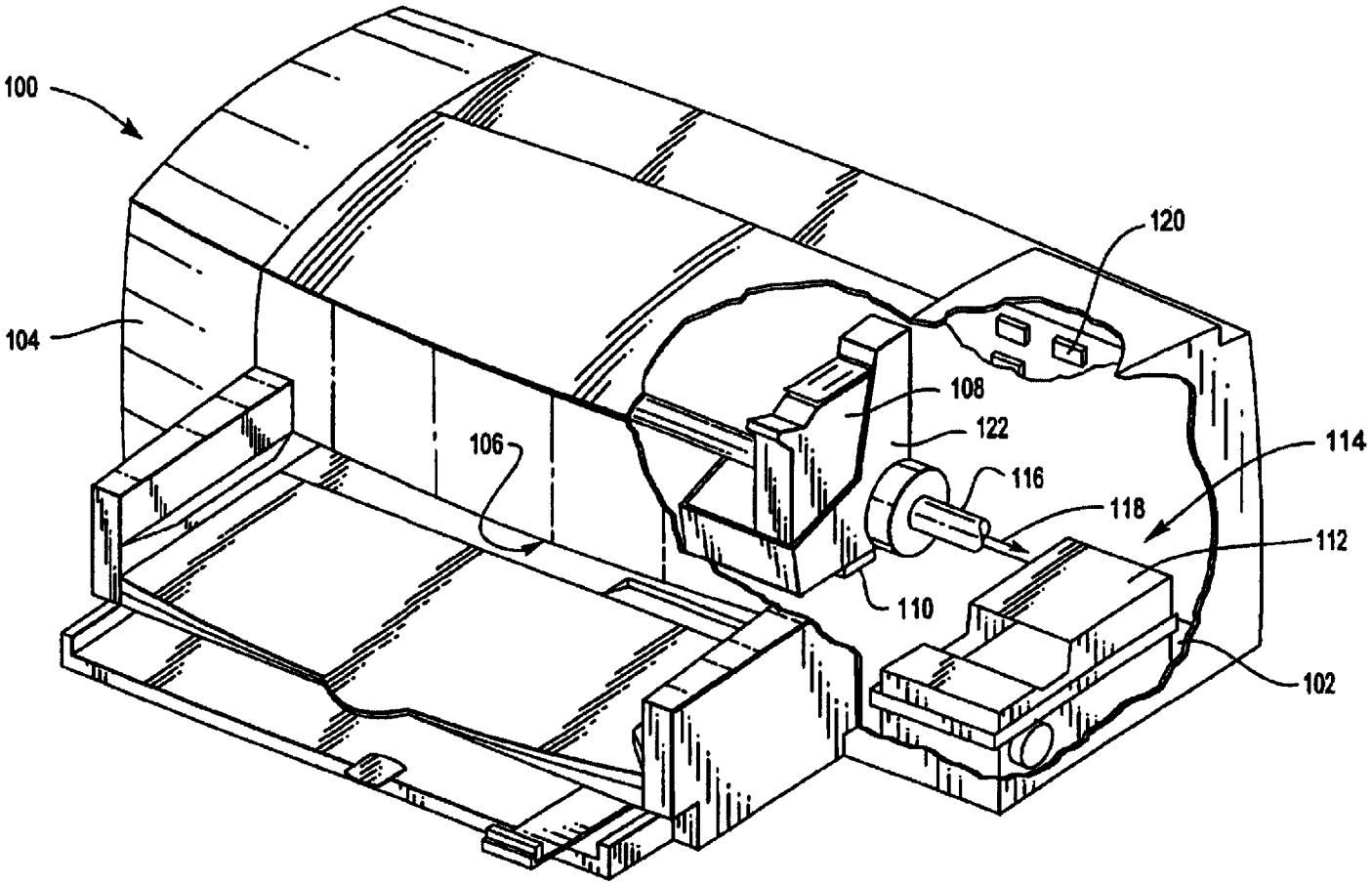
FIG. 1 is a fragmented, partially schematic, perspective view of one form of an inkjet printing mechanism in the prior art.

For convenience, the concepts of the present invention are illustrated in the environment of an inkjet printer 100, while it is understood that the present invention as illustrated by the exemplary embodiment can also be used in other inkjet printing mechanisms such as facsimile machines and copiers.

The typical inkjet printer 100 includes a chassis 102 surrounded by a housing or casing enclosure 104. Sheets of print media (not shown) for example paper are fed through a print zone 106 within which images are imprinted onto the media sheets.

The printer 100 also has a printer controller, illustrated schematically as a microprocessor 120, that receives instructions from a host device, typically a computer, such as a personal computer (not shown), and manages different operations of different components of the printer 100.

A carriage guide rod 116 is supported by the chassis 102 to slidably support an inkjet carriage 122 for travel back and forth across the print zone 106 along a scanning axis 118 defined by the guide rod 116. To provide carriage positional feedback information to printer controller 120, an optical encoder reader (not shown) can be mounted to carriage 122 to read an encoder strip extending along the path of carriage travel.

The carriage 122 is also propelled along guide rod 116 into a servicing region, as indicated generally by arrow 114, located within the interior of the casing 104. The servicing region 114 houses a service station 112, which may provide various conventional printhead servicing functions as generally understood in the art.

In the print zone 106, the media sheet receives ink from an inkjet cartridge 108 on the carriage. The cartridge 108 is also often called a "pen" by those in the art. The illustrated pen 108 includes a reservoir (not shown) for storing a supply of ink. The pen 108 also has a printhead 110, which has an orifice plate with a plurality of nozzles formed therethrough in a manner well-known to those skilled in the art. The illustrated printhead 110 is a thermal inkjet printhead, although other types of printheads may be used, such as piezoelectric printheads.

In the present application, only part of the pen servicing functions is discussed, namely, wiping of the printhead 110. It is understood that a wiping mechanism can be incorporated in the service station 112 as illustrated in U.S. Pat. No. 6,132,026, assigned to the present assignee, Hewlett-Packard Company. Alternatively, as shown in the exemplary embodiment of the present invention illustrated by FIGS. 2–4, the wiping mechanism can be separated from the service station 112 and mounted on the chassis 102 alone.

Figure 2:
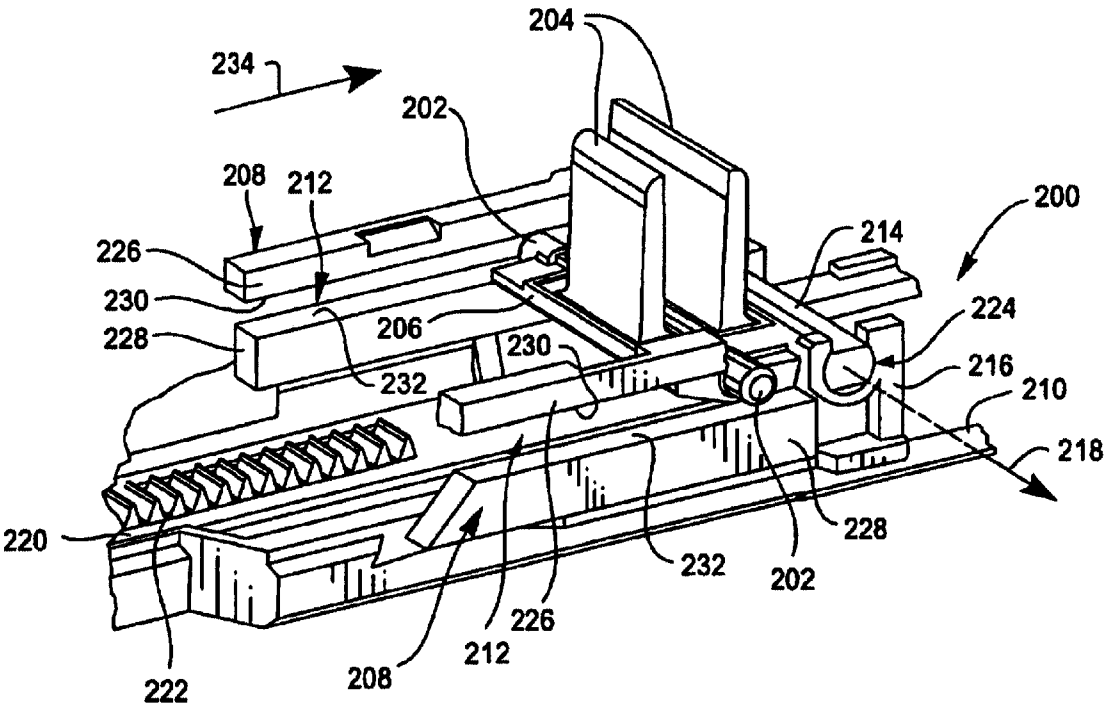
FIG. 2 is a perspective view illustrating an exemplary embodiment of the present invention of a wiper assembly that can be used in the printing mechanism of FIG. 1.

A wiper assembly 200, as illustrated in FIG. 2, is mounted on the chassis 102 and beneath the pen 108 when the pen 108 is in a position for wiping (see FIG. 1). The wiper assembly 200 has a pair of flexible wiper blades 204 mounted on a platform 206 for wiping a printhead, illustrated as the printhead 110 in FIG. 1. The wiping occurs when a rack 220 connected to the platform 206 slides along a slot (not shown) defined within a base frame 210 of the wiper assembly. The rack 220 is driven back and forth along the slot by a rotatable wiper gear (not shown), which engages a plurality of engaging teeth 222 on the rack 220. Furthermore, the wiper gear is rotated by a motor (not shown) in the printer through a gear train (not shown) therebetween as generally understood in the art. In addition, both the slot and the rack 220 extend in a direction substantially parallel to the direction in which the nozzles (not shown) of the printhead 110 are aligned. Such a direction is substantially parallel to the media advancement direction 234, in which the media sheet is advanced through the print zone 106 (FIG. 1) during printing operations.

A pair of frame walls 208 respectively located at two sides of the base 210 project upward in the exemplary embodiment of the present invention and extend horizontally in a direction substantially parallel to the rack 220. Each wall 208 has an opening or guide track 212 formed therein by an upper layer 226 and a lower layer 228 spaced from each other; each layer extends parallel to the media advancement direction 234 and has an inner surface 230, 232 respectively facing each other. On the other hand, the platform 206 has two projections 202 at two respective sides for fitting into the opening 212. In this way, the platform 206 is restricted to slide along the guide tracks 212 during the wiping process.

Furthermore, the rack 220 has a support 216, which extends upward and is mounted on the rack 220 at an end away from the engaging teeth 222. A pivot arm 214 at an end of the platform 206 fits into a pivot slot 224 at an end of the support such that the platform 206 is rotatably mounted to the support 216. In this way, when the rack 220 slides back and forth along the slot (not shown), the platform 206 moves accordingly as driven by the support 216.

In addition, the openings or guide tracks 212 have a width slightly larger than the diameter of the projections 202 so that the platform is able to rotate slightly in an upward or a downward direction about an axis 218 passing through the center of the pivot arm. Such a slight rotation of the platform about the axis 218 allows the projections 202 to contact different inner surfaces of the upper and lower layers during different wiping strokes, which will be discussed in more details with reference to FIGS. 3 and 4.

For the purpose of this application, a forward stroke of a wiping process in the exemplary embodiment is defined as the wiping of the printhead when the wiper assembly moves from its home position in front of the printhead to a position behind the printhead in the media advance direction 24. Such a forward stroke wiping is to wipe off ink residues on the printhead. A backward stroke occurs subsequent to the forward stroke, and during the backward stroke, the wiper assembly moves from the position behind the printhead back to its home position.

It is understood that the wiping force on the printhead by the wiper blade is substantially affected by the pressure on the printhead by the wiper blade. Furthermore, the pressure is mainly affected by the interference between the wiper blade and the printhead. The exemplary embodiment allows such an interference to be adjusted during the forward and backward stroke respectively so that the wiping force on the printhead can also be adjusted.

Figure 3:
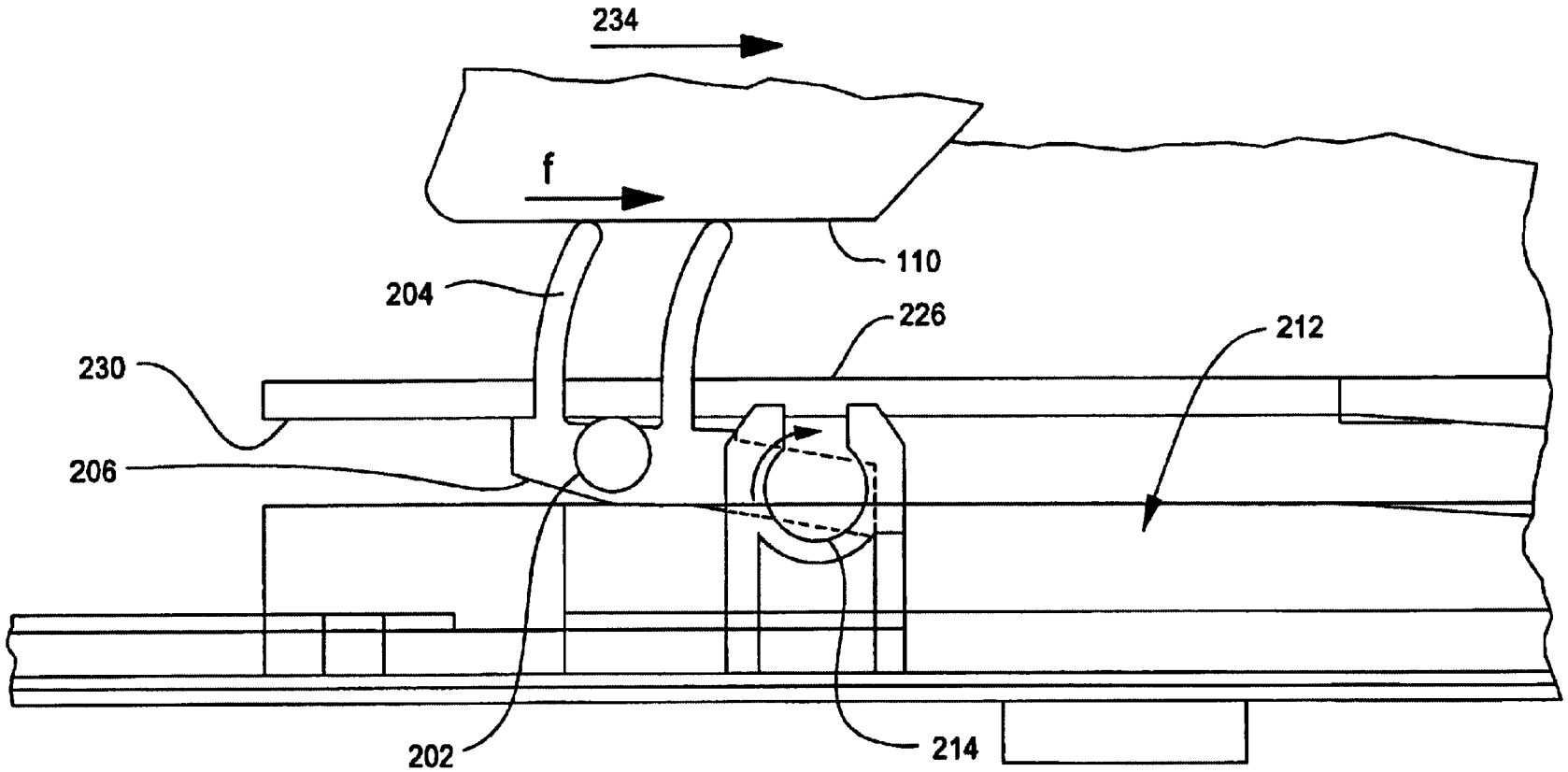
FIGS. 3 and 4 are side views illustrating wiping of the printhead during different strokes by using the wiper assembly of FIG. 2.

During the forward stroke as shown in FIG. 3, due to the interaction between the wiper blade 204 and the printhead 110, the printhead 110 exerts a force on the wiper blade 204 in a direction opposite to the direction in which the wiper assembly moves. It is noted that the guide tracks 212 have a width slightly larger than the diameter of the projections 202 and the projections are allowed to move upward or downward slightly within the boundary of the guide tracks 212. It is further noted that during the forward stroke, the wiper assembly moves in a direction opposite to the media advancement direction 234 and the wiper blade 204 is located behind the pivot arm 214 about which the platform rotates. Therefore during the forward stroke, the force on the wiper blade exerted by the printhead 110 drives the platform 206 upward until the projections 202 reach the inner surfaces 230 of the upper layers 226. In this way, the wiper blade 204 interacts with the printhead 110 with maximum interference during the forward stroke. As a result, the wiper blade 204 exerts a maximum wiping force on the printhead 110 during the forward stroke.

Figure 4:
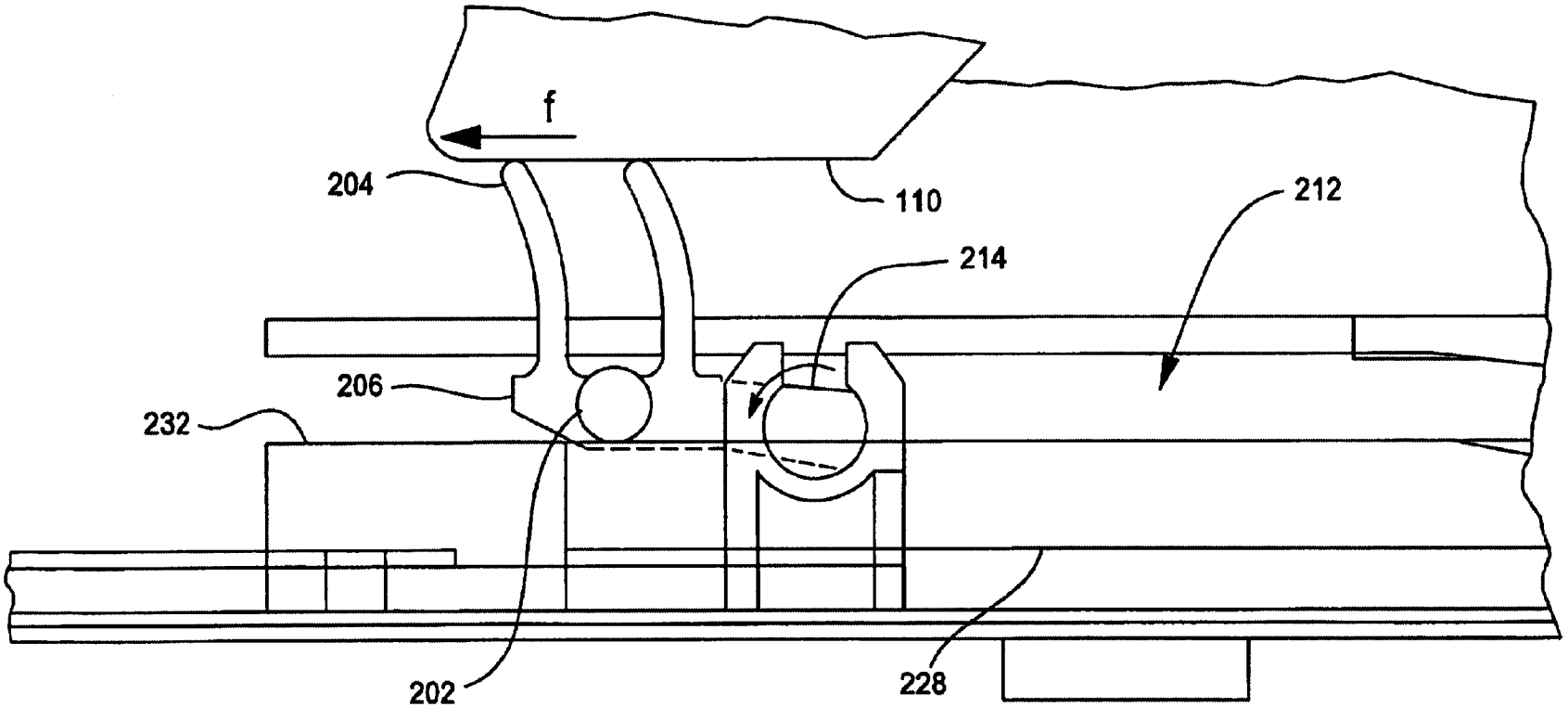

During the backward stroke as shown in FIG. 4, however, the force on the wiper blade 204 exerted by the printhead 110 drives the platform 206 downward until the projections 202 reach the inner surfaces 232 of the lower layers 228. In this way, the wiper blade 204 interacts with the printhead 110 with a minimum interference during the backward stroke and exerts a minimum wiping force on the printhead.

The exemplary embodiment adjusts the wiping force by mechanically adjusting the interference between the wiper blade and the printhead. Alternatives can be made. For example, it is noted that the wiper blade 204 contacts the printhead at different sides of the wiping end during the forward and backward strokes respectively. Therefore, the wiper blade can also exert different wiping forces on the printhead during different strokes if the two sides of wiping end have different friction coefficients. Such a design can be achieved by, for example, using different materials to form the different sides of the wiping end. In that case, the mechanical adjustment of the interference as discussed above is not needed.

What is claimed is:

1. A method for wiping a printhead of an inkjet printing mechanism, comprising:

exerting a first amount of wiping force on the printhead for wiping the printhead in a first direction; and exerting a second amount of wiping force on the printhead for wiping the printhead in a second direction opposite to the first direction, wherein the first amount of wiping force is larger than the second amount of wiping force.

2. The method of claim 1, further comprising:

providing a wiper blade for wiping the printhead, and adjusting a character of the wiper blade between the two wiping steps so that the wiper blade exerts different amounts of wiping force on the printhead during the two wiping steps.

3. The method of claim 2, wherein the printhead defines a printhead plane, and wherein the adjusting step includes adjusting a position of the wiper blade in a direction perpendicular to the printhead plane.

4. The method of claim 2, wherein the adjusting step includes adjusting an interference between the wiper blade and the printhead to vary the wiping force on the printhead.

5. The method of claim 1, further comprising:

providing a wiper blade for wiping the printhead, providing a platform atop which the wiper blade rests, the platform having a projection at one side thereof, providing a guide track along which the projection moves, the track having an upper surface and a lower surface, the projection contacting the upper surface during the step of wiping the printhead in the first direction so that a first amount of interference between the wiper blade and the printhead occurs, and the projection contacting the lower surface during the step of wiping the printhead in the second direction so that a second amount of interference between the wiper blade and the printhead occurs.

6. The method of claim 1, further comprising:

providing a wiper blade with a first and a second wiping surface;

wiping the printhead in the first direction by using the first wiping surface; and wiping the printhead in the second direction by using the second wiping surface, wherein the frictional coefficient of the first wiping surface is different from the frictional coefficient of the second wiping surface so that the wiper blade exerts different mounts of wiping force on the printhead during the two wiping steps.

7. A wiper assembly for wiping a printhead in an inkjet printing mechanism including a chassis, with the printhead on a carriage supported by the chassis for moving to a wiping position, the assembly comprising:

a guide track mounted to the chassis;

a platform movable along the track in a forward and a backward direction during a forward and a backward wiping stroke respectively;

a wiper blade mounted on the platform for wiping the printhead when the printhead is in the wiping position; and means for adjusting a character of the wiper blade so that the wiper blade exerts different amounts of wiping forces on the printhead during the forward and the backward strokes.

8. The assembly of claim 7, wherein the adjusting means includes means for adjusting an interference between the wiper blade and the printhead.

9. The assembly of claim 7, wherein the printhead defines a printhead plane, and wherein the adjusting means includes means for adjusting a position of the wiper blade in a direction perpendicular to the printhead plane.

10. The assembly of claim 7, wherein the guide track has an upper surface and a lower surface, wherein the platform includes a projection for fitting into and moving along the track, and wherein the projection moves in contact with the upper surface during the forward stroke and with the lower surface during the backward stroke so that the wiper blade exerts different amounts of wiping forces on the printhead during the forward and the backward strokes.

11. The assembly of claim 10, further comprising a support slidable within the printing mechanism in a direction parallel to a printhead plane defined by the printhead, wherein the platform is rotatably mounted to the support so that the platform is rotated upward due to the interaction between the printhead and the wiper blade during the forward stroke until the projection reaches the upper surface and is rotated downward during the backward stroke until the projection reaches the lower surface.

12. An inkjet printing mechanism, comprising:

a chassis;

a printhead on a carriage supported by the chassis for moving to a wiping position, the printhead surface defining a printhead surface; and a wiper assembly including a guide track mounted to the chassis;

a platform movable along the track in a forward and a backward direction during a forward and a backward wiping stroke respectively;

a wiper blade mounted on the platform for wiping the printhead when the printhead is in the wiping position; and means for adjusting a character of the wiper blade so that the wiper blade exerts different amounts of wiping forces on the printhead during the forward and the backward strokes.

* * * * *